US008585244B1

(12) United States Patent
Liu et al.

(10) Patent No.: US 8,585,244 B1
(45) Date of Patent: Nov. 19, 2013

(54) LED LAMP

(75) Inventors: Hong-Ping Liu, Taichung (TW); Hui-Ju Hsu, Taichung (TW); Yen-Wei Ho, Taichung (TW)

(73) Assignee: Genius Electronic Optical Co., Ltd., Taichung (TW)

( * ) Notice: Subject to any disclaimer, the term of this patent is extended or adjusted under 35 U.S.C. 154(b) by 0 days.

(21) Appl. No.: 13/565,864

(22) Filed: Aug. 3, 2012

(30) Foreign Application Priority Data

May 31, 2012 (TW) ..... 101119559 A

(51) Int. Cl.
*F21S 4/00* (2006.01)

(52) U.S. Cl.
USPC ..... 362/249.02; 362/294; 362/311.01

(58) Field of Classification Search
USPC ..... 362/249.02, 218, 221, 294, 311.01
See application file for complete search history.

(56) References Cited

U.S. PATENT DOCUMENTS

| | | | | |
|---|---|---|---|---|
| 7,950,828 | B2 * | 5/2011 | Zhang et al. | 362/294 |
| 2006/0098438 | A1 * | 5/2006 | Ouderkirk et al. | 362/294 |
| 2006/0187660 | A1 * | 8/2006 | Liu | 362/294 |

* cited by examiner

*Primary Examiner* — David V Bruce
(74) *Attorney, Agent, or Firm* — Bacon & Thomas, PLLC

(57) ABSTRACT

An LED lamp includes a heat dissipating base and a plurality of light strips. The heat dissipating base is formed by aluminum extrusion and has a length direction defined by the aluminum extrusion direction. The heat dissipating base has a main body and a plurality of heat dissipating fins. The bottom side of the main body has a flat connecting surface. The heat dissipating fins extend outward from the main body. Each light strip has a circuit board and at least one LED module provided on the circuit board. The circuit board of each light strip is provided on the connecting surface of the heat dissipating base. The width (W1) of the connecting surface of the heat dissipating base is greater than three times the width (W2) of each light strip, i.e., W1>3W2.

11 Claims, 9 Drawing Sheets

LED LAMP

BACKGROUND OF THE INVENTION

1. Technical Field

The present invention relates to lighting devices and, more particularly, to a light-emitting diode (LED) lamp.

2. Description of Related Art

Lamp manufacturers must adjust the wattage of lamps according to clients' needs. As far as an LED lamp is concerned, wattage adjustment involves increasing or decreasing the number of LED light strips or LED chips. To accommodate the different numbers of light strips or LED modules, housings of different sizes have to be made, which however is highly uneconomical in terms of both production and storage. Not only must molds of various dimensions be provided for the different housings, but also it is necessary to keep a good variety of housings in stock.

Taiwan Patent No. I342376 discloses a lamp for illumination purposes whose heat dissipation unit (i.e., the housing) is formed by aluminum extrusion. The '376 patent also discloses a circuit board, a plurality of LED modules, a lamp cover glass, side covers, and watertight gaskets provided on the heat dissipating unit. As the length of the heat dissipating unit is freely adjustable by cutting during the aluminum extrusion process, the space required for receiving the desired number of LED modules can be easily obtained by changing the length of the heat dissipating unit, without needing to make additional molds.

However, as the LED modules in the afore-cited patent must be received in a groove of the heat dissipating unit, the provision of the LED modules is subject to limitations. In particular, if it is desired to add more LED modules, there is no other way than by increasing the length of the heat dissipating unit. Also, the number of rows of the LED modules is limited by the location and number of the groove and does not allow flexible adjustment.

BRIEF SUMMARY OF THE INVENTION

One object of the present invention is to provide an LED lamp in which the arrangement and locations of LED modules are not subject to the limitations imposed by the groove in the prior art, and in which therefore the number of the LED modules is subject to less limitations.

Another object of the present invention is to provide an LED lamp which can solve the problem of the prior art that a lamp formed by aluminum extrusion only allows an increase or decrease in the number of LED modules along the length direction of the lamp. In an embodiment of the present invention, the number of LED modules can be increased or decreased not only along the length direction but also along the width direction of the lamp.

To achieve the aforesaid objects, the present invention provides an LED lamp including a heat dissipating base and a plurality of light strips. The heat dissipating base is formed by aluminum extrusion and has a length direction defined by the direction of aluminum extrusion. The heat dissipating base has a main body and a plurality of heat dissipating fins. The main body has a connecting surface on the bottom side, wherein the connecting surface is a flat surface. The heat dissipating fins extend outward from the main body. Each light strip has a circuit board and at least one LED module provided on the circuit board. The circuit board of each light strip is provided on the connecting surface of the heat dissipating base. The width of the connecting surface of the heat dissipating base is W1, the width of each light strip is W2, and W1>3W2.

Preferably, W1 (measured in mm)>3W2 (measured in mm)+12.8 mm.

Preferably, the width of the heat dissipating base is W3, and 140 mm<W3 (measured in mm)<250 mm.

Preferably, the main body of the heat dissipating base further has a rod hole. The rod hole penetrates the main body along the length direction of the heat dissipating base.

Preferably, the LED lamp further includes a front cover, a rear cover, and a bottom cover. The front cover and the rear cover are provided at two ends of the main body respectively. The bottom cover is provided at the bottom side of the main body, is in the form of a flat plate, and covers the connecting surface.

Preferably, the LED lamp further includes a plurality of lenses and a plurality of pressing plates. Each lens is located on the bottom side of one of the corresponding LED modules. Each pressing plate is provided on the connecting surface, corresponds in position to one of the light strips, and presses the corresponding light strip and the at least one lens on the bottom side of the corresponding light strip against the connecting surface. Each pressing plate has at least one through hole through which at least one of the at least one lens on the corresponding light strip partially juts out and is thus exposed.

Preferably, the LED lamp further includes a plurality of thermally conductive pads. Each thermally conductive pad is provided between a corresponding one of the light strips and the connecting surface.

Preferably, the connecting surface is provided with a plurality of connecting holes, and the light strips are fixed to the connecting surface via the connecting holes and a plurality of connecting elements. The connecting holes are formed by drilling after the heat dissipating base is formed by aluminum extrusion.

Preferably, the connecting holes are threaded holes, and the connecting elements are bolts.

Preferably, the LED lamp further includes two long-side decorative elements respectively provided on two sides of the heat dissipating base that extend along the length direction.

Preferably, the LED lamp further includes two short-side decorative elements respectively provided at two ends of the heat dissipating base in the length direction.

BRIEF DESCRIPTION OF THE SEVERAL VIEWS OF THE DRAWINGS

The structure and features of the present invention will be best understood by referring to the following detailed description of the preferred embodiments in conjunction with the accompanying drawings, in which.

DETAILED DESCRIPTION OF THE INVENTION

Figure 1:
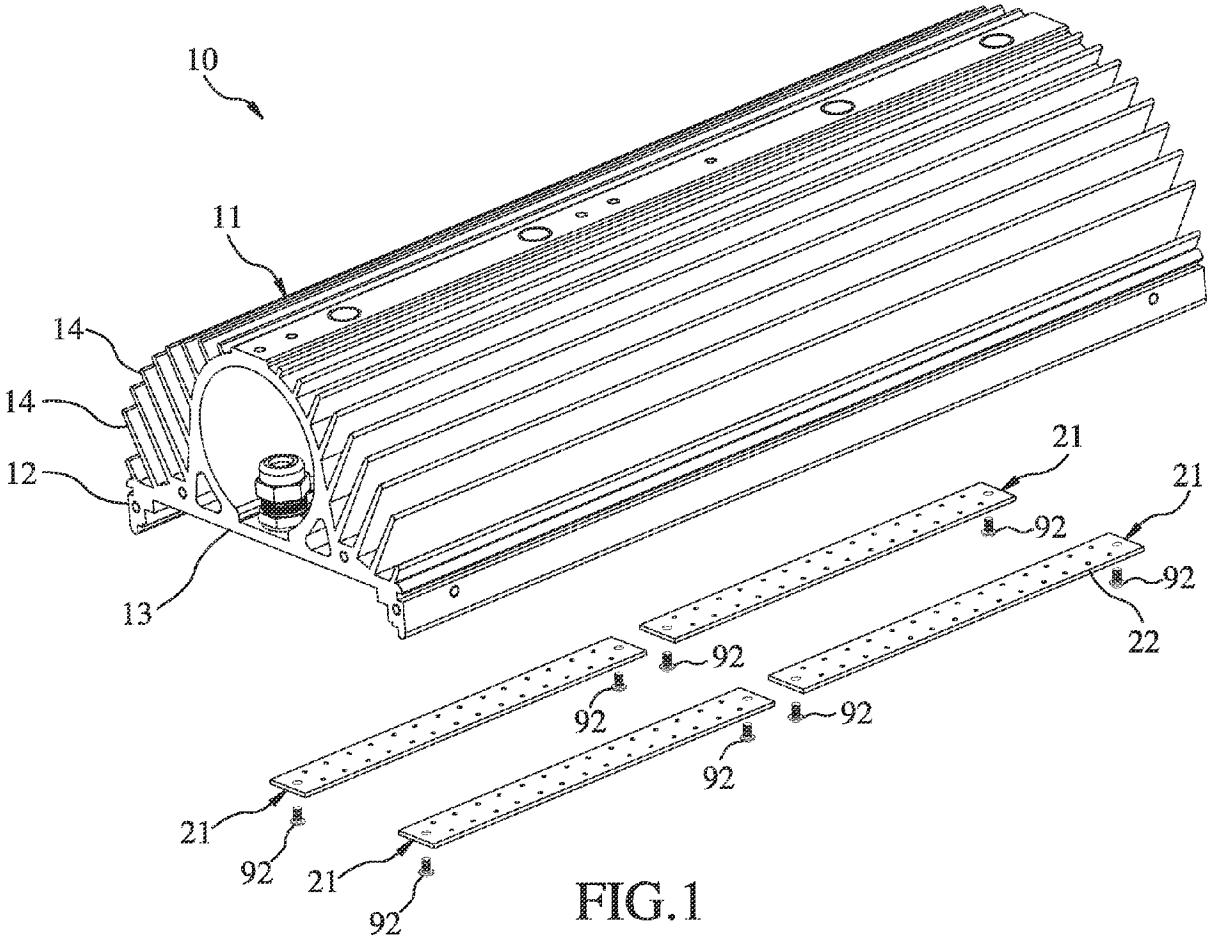
FIG. 1 is an exploded perspective view of the first preferred embodiment of the present invention.
Figure 2:
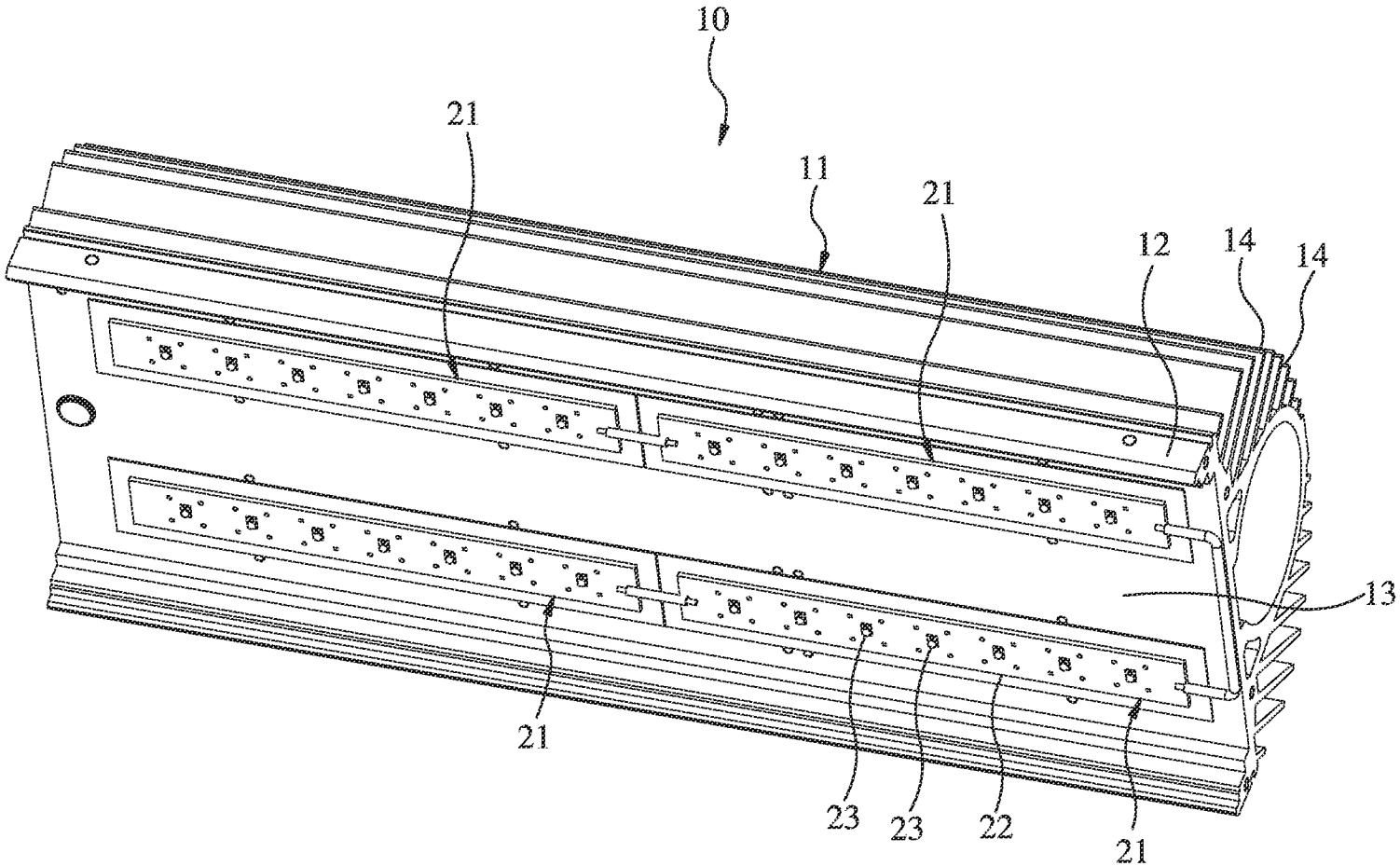
FIG. 2 is an assembled perspective view of the first preferred embodiment of the present invention, showing in particular its bottom side.
Figure 3:
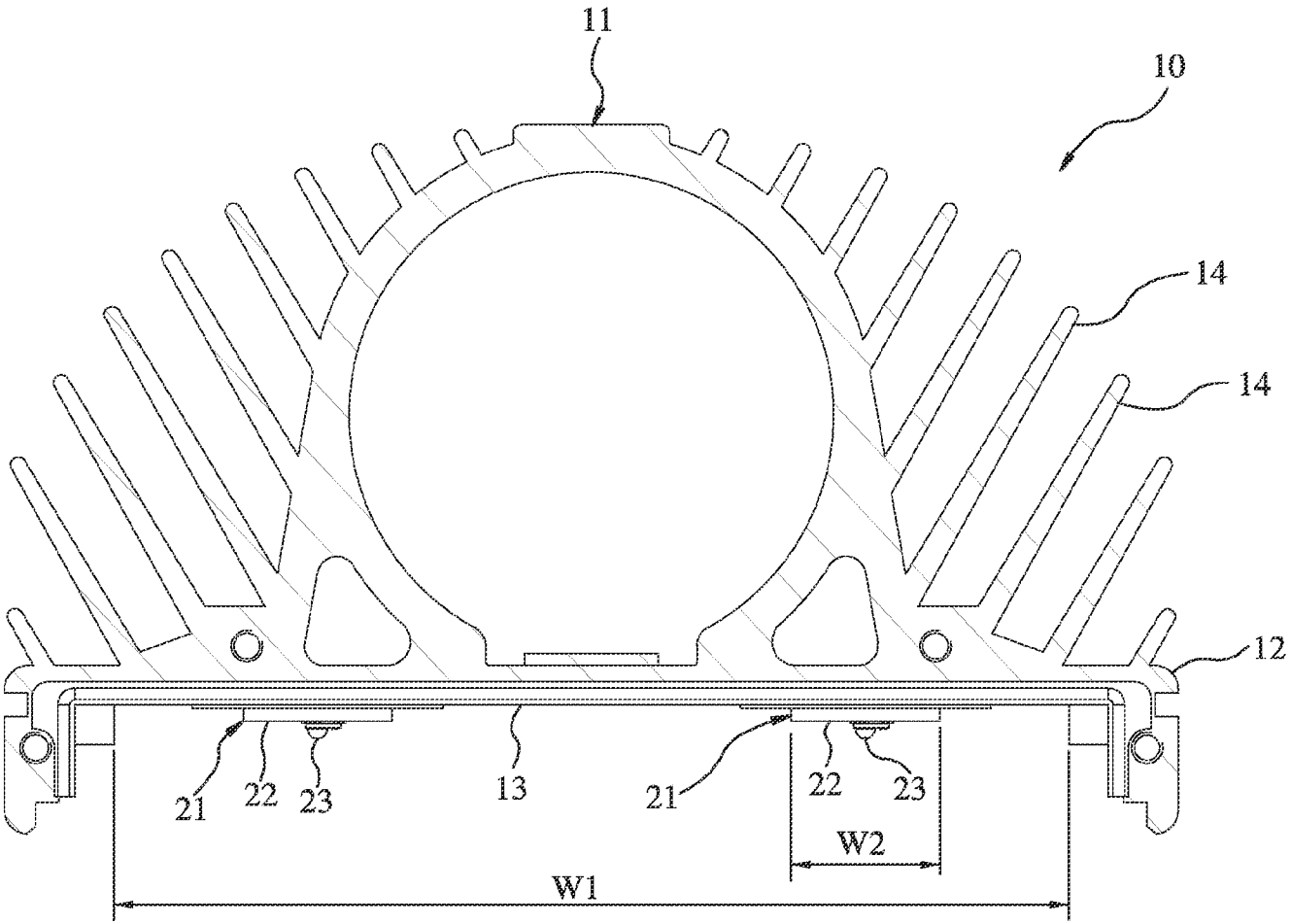
FIG. 3 is a sectional view of the first preferred embodiment of the present invention.
Figure 4:
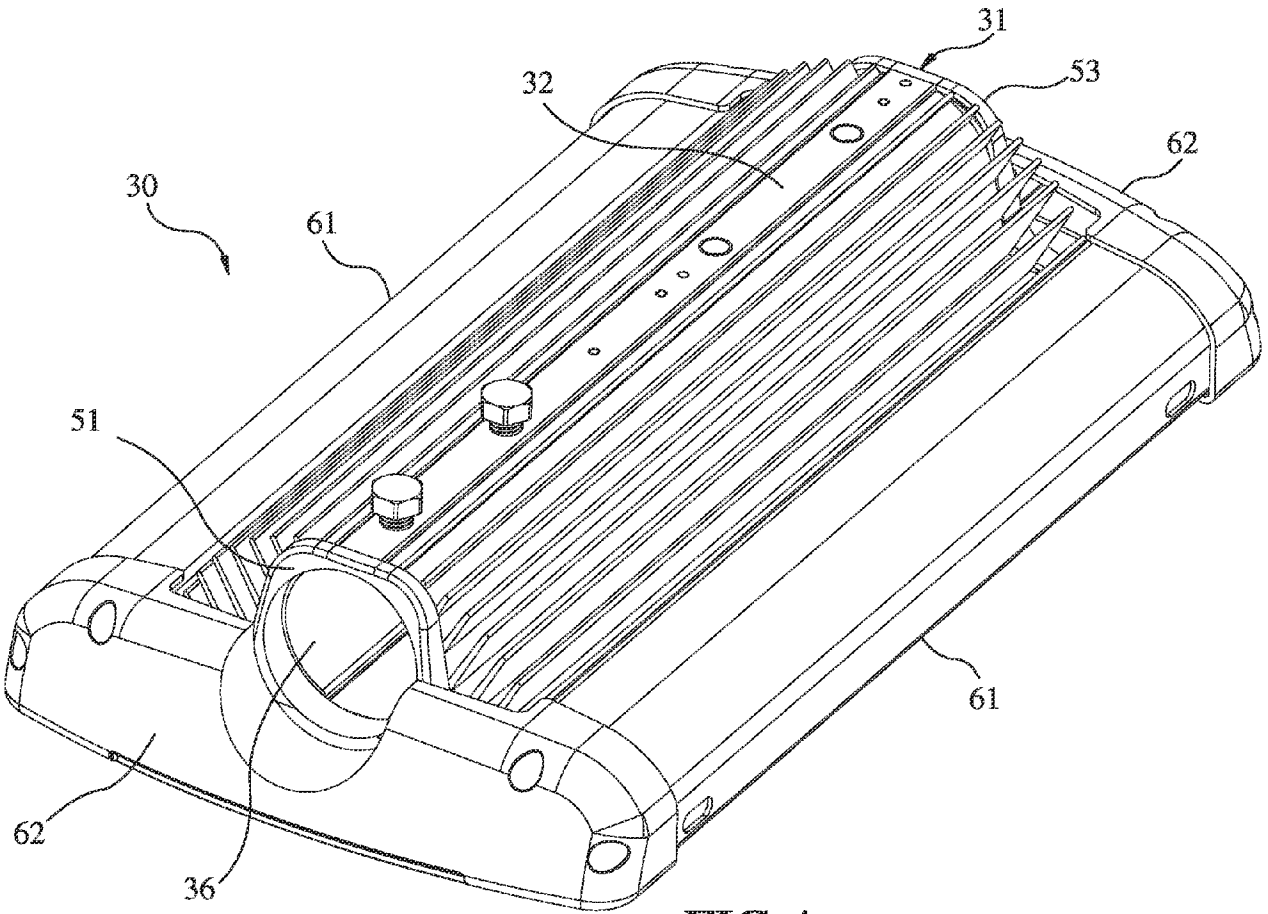
FIG. 4 is an assembled perspective view of the second preferred embodiment of the present invention.
Figure 5:
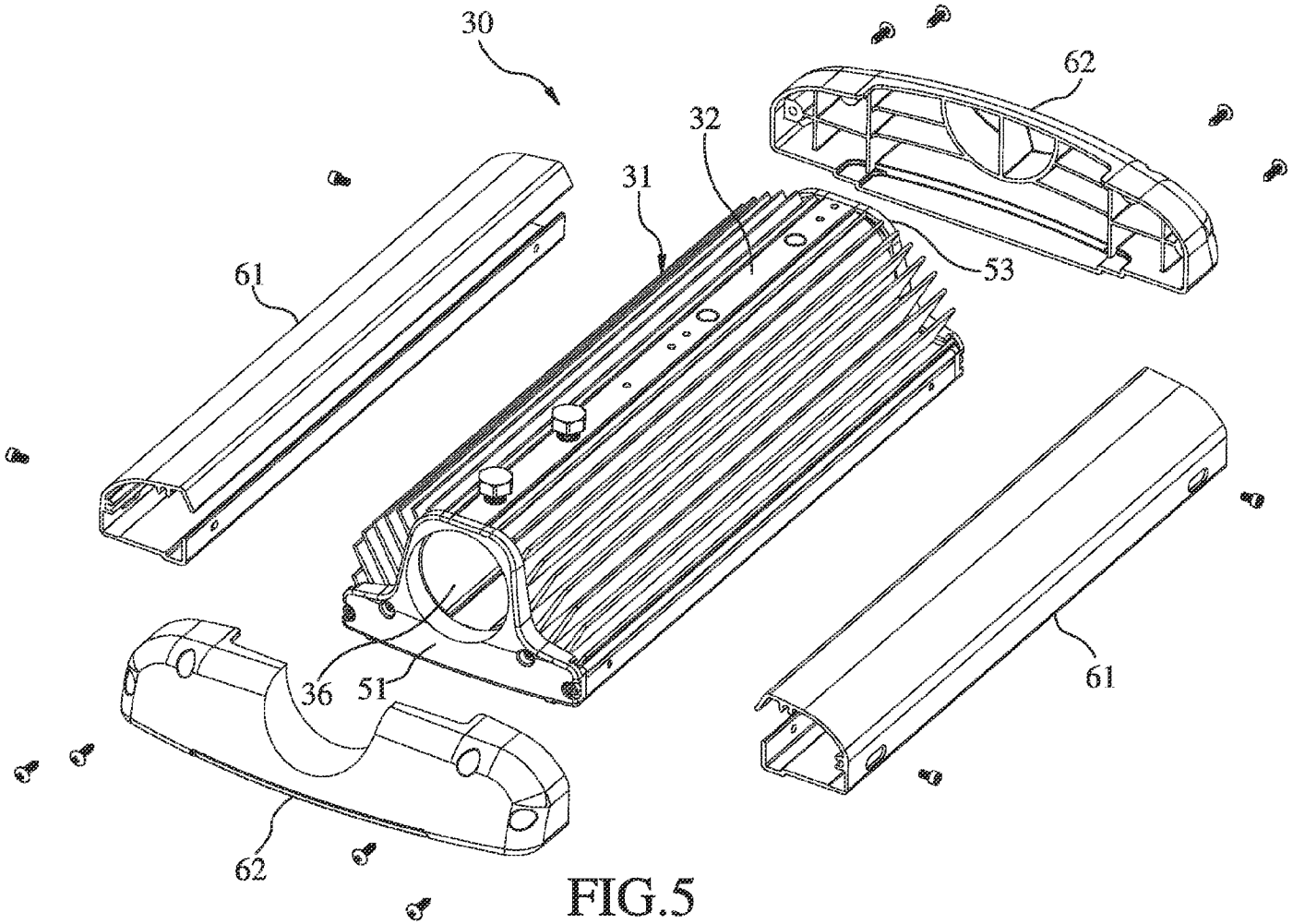
FIG. 5 is a partially exploded perspective view of the second preferred embodiment of the present invention, wherein the long-side decorative elements and the short-side decorative elements are detached.
Figure 6:
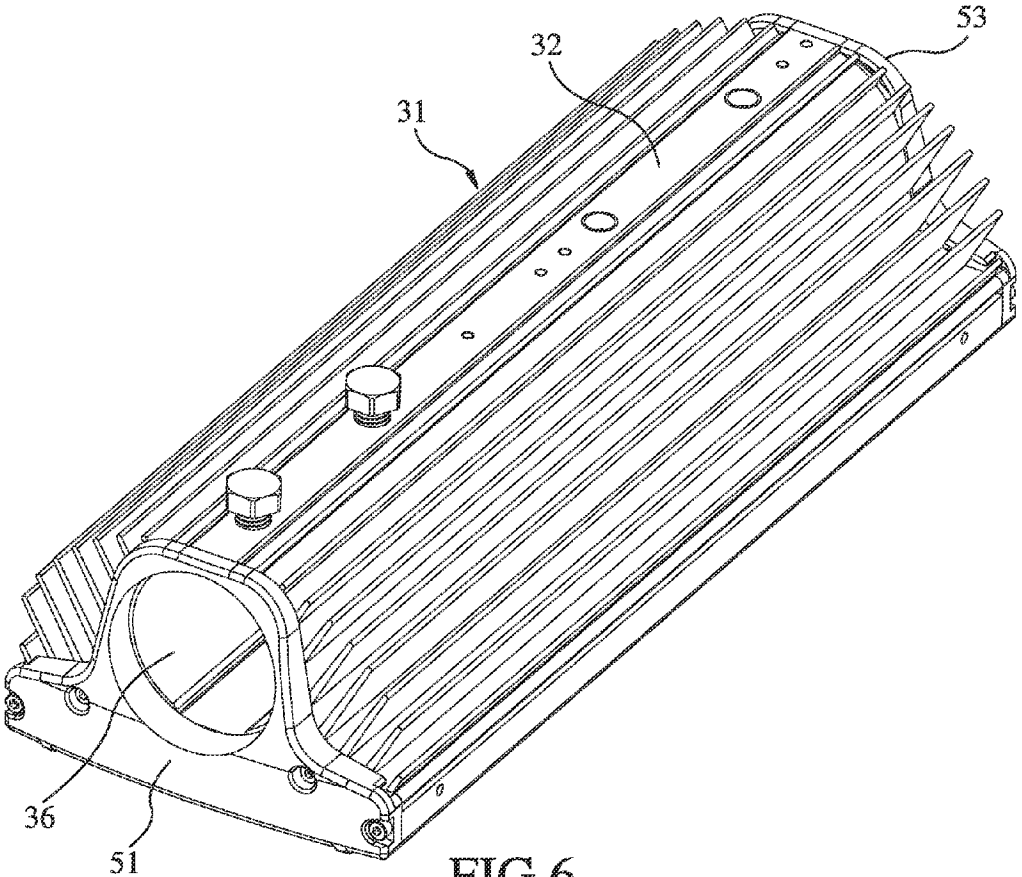
FIG. 6 is a perspective view of the second preferred embodiment of the present invention, with the long-side decorative elements and the short-side decorative elements removed.
Figure 7:
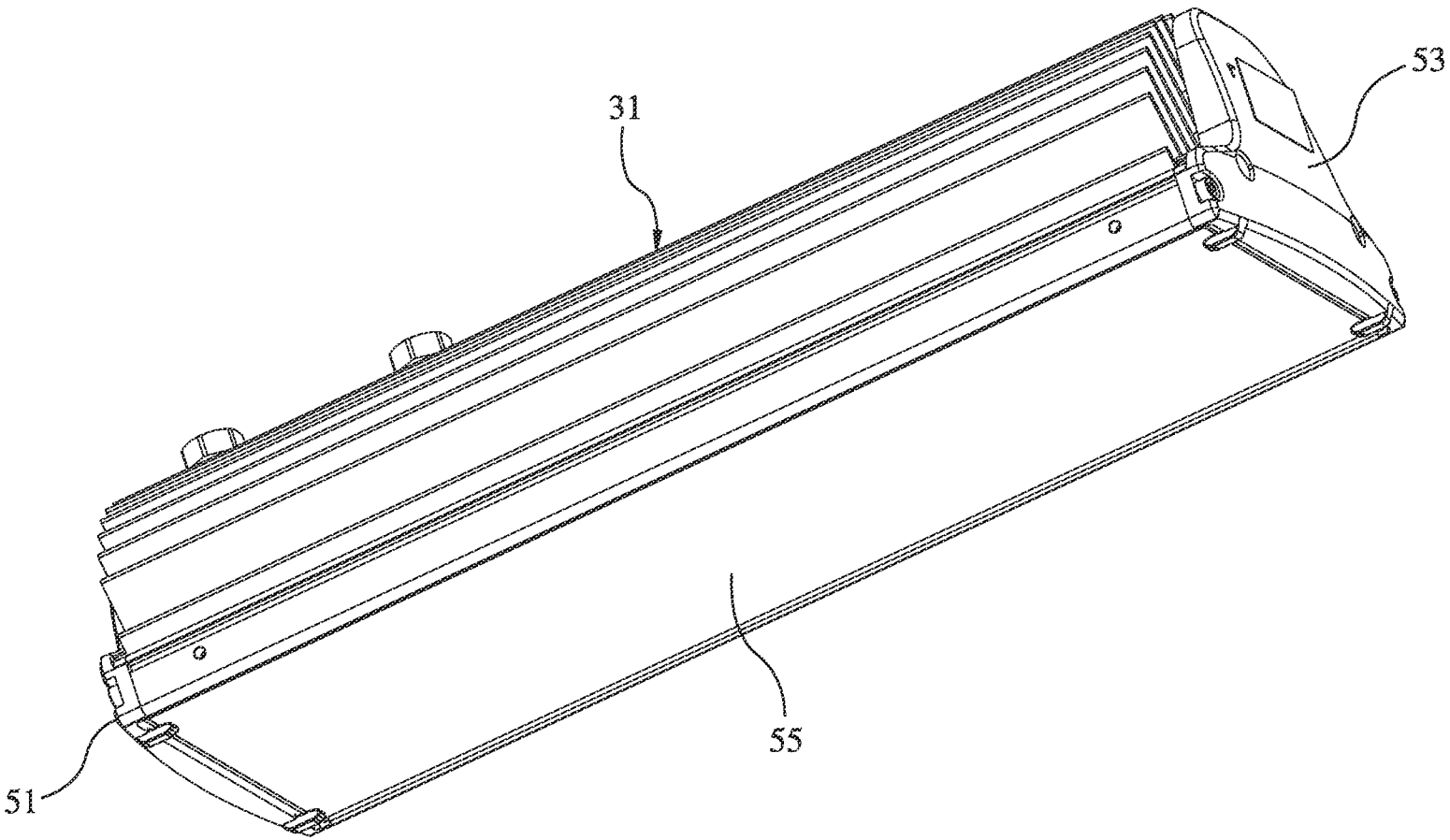
FIG. 7 is a perspective view of the assembly of FIG. 6, showing in particular its bottom side.
Figure 8:
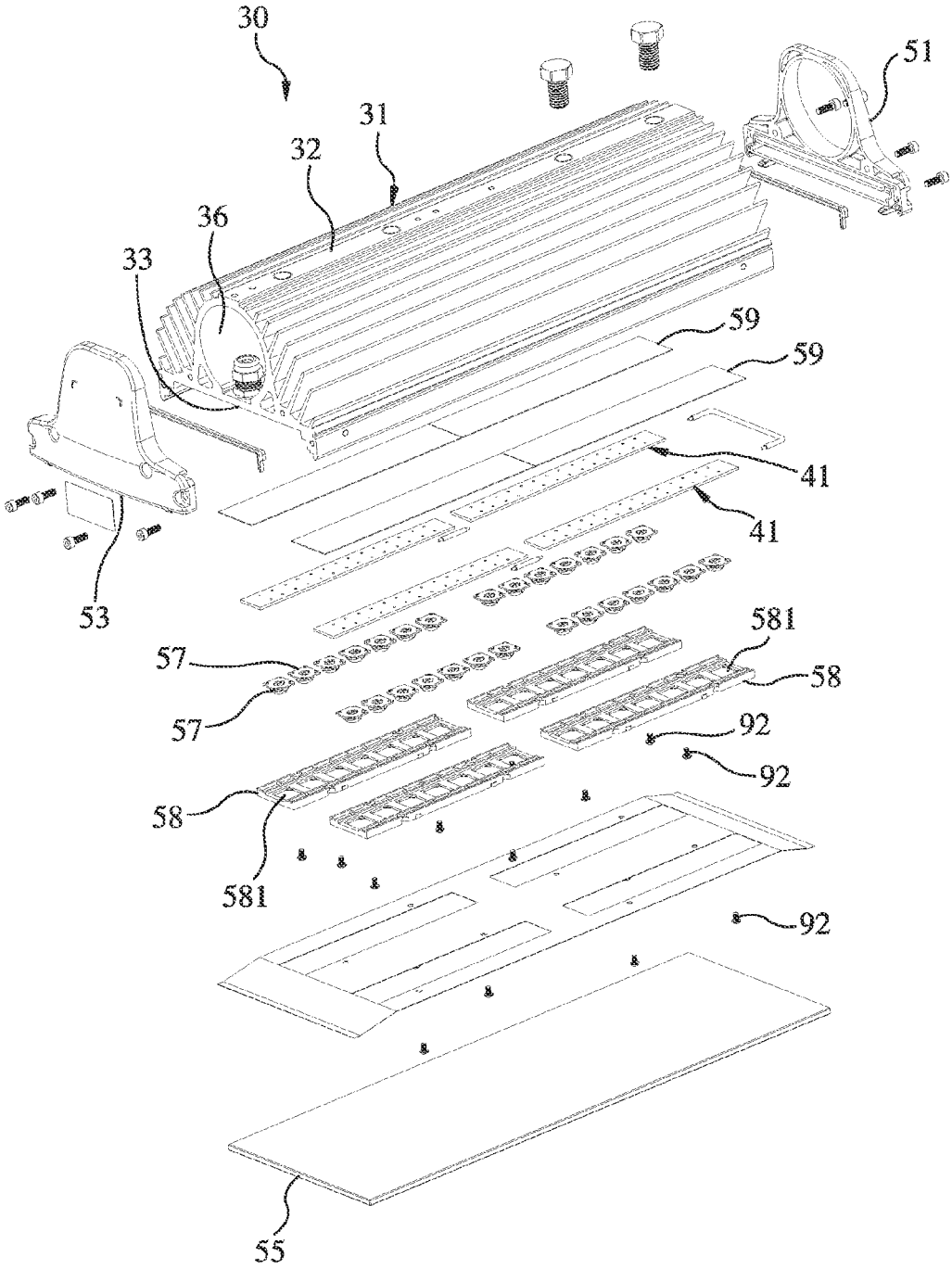
FIG. 8 is an exploded perspective view of the assembly of FIG. 6.
Figure 9:
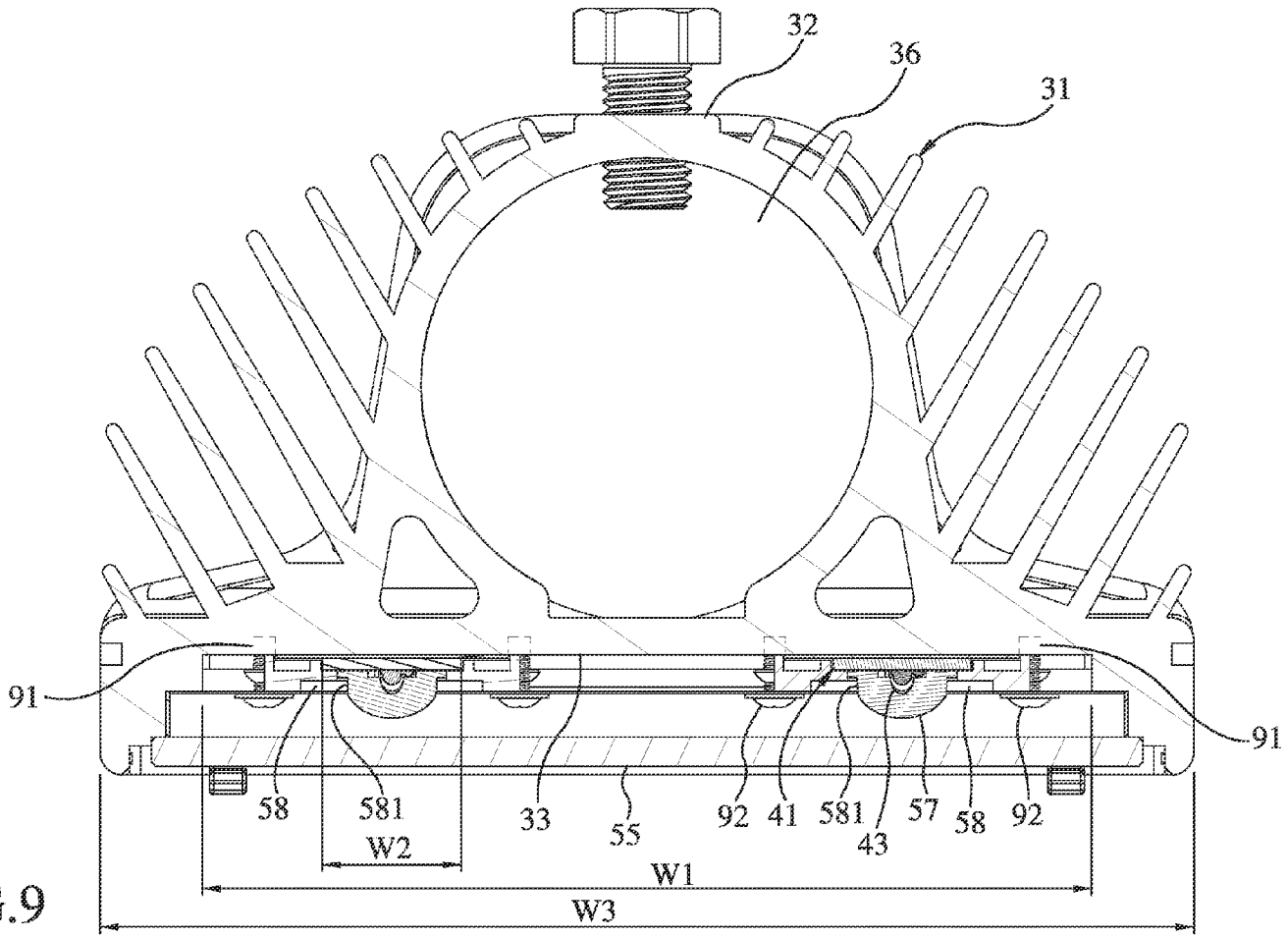
FIG. 9 is a sectional view of the second preferred embodiment of the present invention.

Referring to FIG. 1 to FIG. 3, an LED lamp 10 according to the first preferred embodiment of the present invention is composed essentially of a heat dissipating base 11 and a plurality of light strips 21.

The heat dissipating base 11 is formed by aluminum extrusion and has a length direction defined by the direction of aluminum extrusion. The heat dissipating base 11 has a main body 12 and a plurality of heat dissipating fins 14. The main body 12 has a connecting surface 13 on the bottom side, wherein the connecting surface 13 is a flat surface. The heat dissipating fins 14 extend outward from the main body 12.

There are four light strips 21 in this embodiment. Each light strip 21 has a circuit board 22 and at least one LED module 23 provided on the circuit board 22. The circuit board 22 of each light strip 21 is provided on the connecting surface 13 of the heat dissipating base 11. In the first embodiment, each circuit board 22 is provided with a plurality of LED modules 23. However, it is also feasible for each circuit board 22 of the present invention to be provided with only one LED module 23 instead of plural LED modules 23. Besides, the light strips 21 in the first embodiment are fastened to the connecting surface 13 by bolts 92.

The connecting surface 13 of the heat dissipating base 11 has a width of W1, each light strip 21 has a width of W2, and W1>3W2.

According to the structure described above, the connecting surface 13 is a flat surface and is not provided with the groove in the prior art. Therefore, the light strips 21 are directly provided on the connecting surface 13 at positions designed by the manufacturer. Without the limitations imposed by the groove in the prior art, the provision of the light strips 21 is more convenient and more flexible. When it is desired to add more light strips 21, the additional light strips 21 can be provided in the vacant space of the connecting surface 13 without having to increase the length of the housing (i.e., the heat dissipating base 11), thanks to the absence of the limitations imposed by the groove in the prior art.

The foregoing definition of W1>3W2 is intended mainly to allow three or more light strips 21 to be arranged side by side along the width direction of the connecting surface 13. While only two light strips 21 are shown in FIG. 2 as arranged in the width direction of the connecting surface 13, this is an example only. Three or more light strips 21 can be provided along the width direction of the connecting surface 13.

It can be known from the above that, in the first embodiment, the arrangement and locations of the LED modules are no longer subject to the limitations imposed by the groove in the prior art; consequently, the number of the LED modules is subject to less limitations. Further, the first embodiment solves the problem in the prior art that a lamp formed by aluminum extrusion only allows an increase or decrease in the number of LED modules along the length direction. More specifically, the first embodiment allows the number of LED modules to be increased or decreased in the width direction as well as in the length direction.

Referring to FIG. 4 to FIG. 9, the LED lamp 30 in the second preferred embodiment of the present invention is substantially the same as that in the first embodiment except for the following.

It is further defined that W1 (measured in mm)>3W2 (measured in mm)+12.8 mm. The additional width of 12.8 mm is provided in compliance with safety regulations which pay particular attention to the spacing between the light strips 41 and which therefore require a greater width of the connecting surface 33.

In addition, it is defined that the heat dissipating base 31 has a width of W3, and 140 mm<W3 (measured in mm)<250 mm. The range of W3 is set by taking into account both heat dissipation efficiency and advantage in production costs, the latter of which involves the size and extrusion pressure of the aluminum extrusion machine.

In the second embodiment, the width W1 of the connecting surface 33 is 132 mm, the width W2 of each light strip 41 is 19 mm, and the width W3 of the heat dissipating base 31 is 150 mm. The widths W1, W2, and W3 may vary as appropriate provided that the foregoing definitions are met.

Moreover, the main body 32 of the heat dissipating base 31 has a rod hole 36 which penetrates the main body 32 along the length direction of the heat dissipating base 31. The rod hole 36 is provided mainly for insertion by a frame member (not shown), such as a rod, of a street lamp so that the LED lamp 30 can be fixed to the rod.

The LED lamp 30 further includes a front cover 51, a rear cover 53, and a bottom cover 55. The front cover 51 and the rear cover 53 are respectively provided at two ends of the main body 32 in the length direction. The bottom cover 55, which is provided at the bottom side of the main body 32, is formed as a transparent flat plate and serves to cover the connecting surface 33.

Furthermore, the LED lamp 30 includes a plurality of lenses 57 and a plurality of pressing plates 58. Each lens 57 is located on the bottom side (i.e., the side facing away from the connecting surface 33) of a corresponding one of the LED modules 43. Each pressing plate 58 is provided on the connecting surface 33 and corresponds in position to one of the light strips 41. Each pressing plate 58 presses the corresponding light strip 41 and the lenses 57 on the bottom side of the corresponding light strip 41 against the connecting surface 33. Each pressing plate 58 also has at least one through hole 581 such that each lens 57 on the corresponding light strip 41 has a portion protruding out of and hence exposed through a corresponding one of the at least one through hole 581. In the second embodiment, each pressing plate 58 has a plurality of through holes 581 through which the corresponding plural lenses 57 are exposed respectively. However, it is also feasible for each pressing plate 58 to have not a plurality of through holes 581 but a single elongate through hole 581 through which the lenses 57 are exposed. In this embodiment, the pressing plates 58 are fastened to the connecting surface 33 by a plurality of bolts 92.

The LED lamp 30 further includes a plurality of thermally conductive pads 59 each provided between one of the light strips 41 and the connecting surface 33. These thermally conductive pads 59 serve to enhance thermal conduction between the light strips 41 and the connecting surface 33 and thereby increase heat dissipation efficiency.

Moreover, the connecting surface 33 is provided with a plurality of connecting holes 91. The light strips 41 are fixed to the connecting surface 33 via the connecting holes 91 and a plurality of connecting elements 92. The connecting holes 91 are formed by drilling after the heat dissipating base 31 is formed by aluminum extrusion. In the second embodiment, the connecting holes 91 are threaded holes, and the connecting elements 92 are bolts.

Additionally, the LED lamp 30 includes two long-side decorative elements 61 and two short-side decorative elements 62. The long-side decorative elements 61 are respectively provided on two sides of the heat dissipating base 31 that extend along the length direction. The short-side decorative elements 62 are respectively provided at two ends of the heat dissipating base 31 in the length direction.

According to the structure described above, the second embodiment has the following advantages: the LED lamp 30 complies with the related safety regulations; the width range of the heat dissipating base 31 features both heat dissipation efficiency and advantage in production costs; the provision of the rod hole 36 facilitates installation on a frame member of a street lamp; the front cover, the rear cover, and the bottom cover provide protection; the lenses 57 provide additional optical properties for light distribution; the pressing plates 58 facilitate fixation of the lenses 57; the thermally conductive pads 59 increase thermal dissipation efficiency; the additionally drilled connecting holes 91 on the connecting surface 33 give the manufacturer freedom in providing the light strips 41; and the long-side decorative elements 61 and the short-side decorative elements 62 enhance physical appearance. It should be pointed out that the long-side decorative elements 61 and the short-side decorative elements 62 can be made of a metal or non-metal material. When made of metal, such as by aluminum extrusion, the decorative elements 61 and 62 also assist in heat dissipation.

The rest of the structure of the second embodiment and the effects to be achieved thereby are the same as those of the first embodiment and will not be described repeatedly.

It should be noted that, while the light strips 21, 41 and the pressing plates 58 in the foregoing embodiments are fastened to the heat dissipating bases 11, 31 by bolts 92, they can also be fastened by a non-threaded means, such as by bonding with an adhesive or by connection between mutually engaging elements. To fasten by connection between mutually engaging elements is a well-known technique as disclosed by Taiwan Patent No. M425240, which provides a mating structure between engaging elements and a lamp base.

What is claimed is:

1. A light-emitting diode (LED) lamp, comprising:

a heat dissipating base formed by aluminum extrusion and having a length direction defined by a direction of the aluminum extrusion, the heat dissipating base having a main body and a plurality of heat dissipating fins, the main body having a bottom side having a connecting surface, the connecting surface being a flat surface, the heat dissipating fins extending outward from the main body; and a plurality of light strips, each said light strip having a circuit board and at least an LED module provided on the circuit board, the circuit board of each said light strip being provided on the connecting surface of the heat dissipating base;

wherein the connecting surface of the heat dissipating base has a width of W1, each said light strip has a width of W2, and W1>3W2.

2. The LED lamp of claim 1, wherein, furthermore, W1 (measured in mm)>3W2 (measured in mm)+12.8 mm.

3. The LED lamp of claim 1, wherein the heat dissipating base has a width of W3, and 140 mm<W3 (measured in mm)<250 mm.

4. The LED lamp of claim 1, wherein the main body of the heat dissipating base further has a rod hole, the rod hole penetrating the main body along the length direction of the heat dissipating base.

5. The LED lamp of claim 1, further comprising a front cover, a rear cover, and a bottom cover, wherein the front cover and the rear cover are provided at two ends of the main body respectively, and the bottom cover is provided at the bottom side of the main body, is formed as a flat plate, and covers the connecting surface.

6. The LED lamp of claim 1, further comprising a plurality of lenses and a plurality of pressing plates, each said lens being located on a bottom side of a corresponding one of the LED modules, each said pressing plate being provided on the connecting surface, corresponding in position to a said light strip, and pressing the corresponding light strip and the at least one lens on a bottom side of the corresponding light strip against the connecting surface, wherein each said pressing plate has at least a through hole through which at least one of the at least a lens on the corresponding light strip partially juts out and is thus exposed.

7. The LED lamp of claim 1, further comprising a plurality of thermally conductive pads each provided between a said light strip and the connecting surface.

8. The LED lamp of claim 1, wherein the connecting surface is provided with a plurality of connecting holes, and the light strips are fixed to the connecting surface by the connecting holes and a plurality of connecting elements, the connecting holes being formed by drilling after the heat dissipating base is formed by the aluminum extrusion.

9. The LED lamp of claim 8, wherein the connecting holes are threaded holes, and the connecting elements are bolts.

10. The LED lamp of claim 1, further comprising two long-side decorative elements respectively provided on two sides of the heat dissipating base that extend along the length direction.

11. The LED lamp of claim 1, further comprising two short-side decorative elements respectively provided at two ends of the heat dissipating base in the length direction.

* * * * *